US005970871A

United States Patent [19]

Andres

[11] Patent Number: 5,970,871

[45] Date of Patent: Oct. 26, 1999

[54] CYLINDER UNIT FOR A WEB-FED PRINTING PRESS HAVING CYLINDERS MOVABLE DURING RUNNING PRODUCTION

[75] Inventor: Miescher Andres, Ittigen, Switzerland

[73] Assignee: Maschinenfabrik WIFAG, Switzerland

[21] Appl. No.: 09/025,709

[22] Filed: Feb. 18, 1998

[30] Foreign Application Priority Data

Feb. 19, 1997 [DE] Germany ..... 297 02 923

[51] Int. Cl.[6] ..... B41F 5/16

[52] U.S. Cl. ..... 101/180; 101/221

[58] Field of Search ..... 101/180, 181, 101/182, 183, 221, 179, 184, 220

[56] References Cited

U.S. PATENT DOCUMENTS

| | | | |
|---|---|---|---|
| 3,329,086 | 7/1967 | Pullen | 101/182 |
| 4,281,595 | 8/1981 | Fujishiro | 101/181 |
| 4,394,835 | 7/1983 | Gertsch et al. | 101/220 |
| 4,398,464 | 8/1983 | Morbitzer et al. | 101/180 |
| 4,442,773 | 4/1984 | Kobayashi | 101/182 |
| 4,798,137 | 1/1989 | Hermach et al. | 101/221 |
| 4,934,265 | 6/1990 | Knauer | 101/221 |

*Primary Examiner*—Edgar Burr
*Assistant Examiner*—Leslie J. Grohusky
*Attorney, Agent, or Firm*—McGlew and Tuttle, P.C.

[57] ABSTRACT

A cylinder unit is provided for a web-fed printing press. The unit includes first and second cylinders which form printing gaps with a common first counterpressure cylinder. Third and fourth cylinders are provided which form printing gaps with a common second counterpressure cylinder. The four cylinders and the two counterpressure cylinders are cylinders of a single H-shaped cylinder bridge. The second and third cylinders are spaced from one another at such a distance that a web can run in between these two cylinders in their printing-on positions at the respective counterpressure cylinders and can run out after wrapping around the two counterpressure cylinders. The first and fourth cylinders are spaced so close to one another that they can be reversed from a printing-on position against their respective counterpressure cylinder into printing-on position in relation to one another.

7 Claims, 2 Drawing Sheets

CYLINDER UNIT FOR A WEB-FED PRINTING PRESS HAVING CYLINDERS MOVABLE DURING RUNNING PRODUCTION

FIELD AND BACKGROUND OF THE INVENTION

The present invention pertains to a cylinder unit for a web-fed printing press.

SUMMARY AND OBJECTS OF THE INVENTION

The primary object of the present invention is to increase the flexibility of a cylinder unit with respect to the formation of printing gaps for a web to be printed on.

According to the invention, a cylinder unit is provided for a web-fed printing press. The unit includes first and second cylinders which form printing gaps with a common first counterpressure cylinder. Third and fourth cylinders are provided which form printing gaps with a common second counterpressure cylinder. The four cylinders and the two counterpressure cylinders are cylinders of a single H-shaped cylinder bridge. The second and third cylinders are spaced from one another at such a distance that a web can run in between these two cylinders in their printing-on positions at the respective counterpressure cylinders and can run out after wrapping around the two counterpressure cylinders. The first and fourth cylinders are spaced so close to one another that they can be reversed from a printing-on position against their respective counterpressure cylinder into printing-on position in relation to one another.

The present invention is based on a cylinder unit whose cylinders form an H-shaped cylinder bridge with four cylinders transferring printing ink onto a web and two central counterpressure cylinders for these four ink transfer cylinders. Two each of the four ink transfer cylinders of the H-shaped cylinder bridge are pivotable into a printing-on position to a common counterpressure cylinder.

According to the present invention, two of the four ink transfer cylinders can be reversed from a printing-on position to their corresponding central counterpressure cylinder into a printing-on position to one another. The other two ink transfer cylinders are located at spaced locations from one another to the extent that a web to be printed on can run in between them unhindered and can run out after wrapping around both counterpressure cylinders. Due to this asymmetric arrangement of the four ink transfer cylinders to the two central counterpressure cylinders of the H-shaped bridge, a maximum flexibility is achieved with respect to the formation of print positions.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENT

Figure 1:
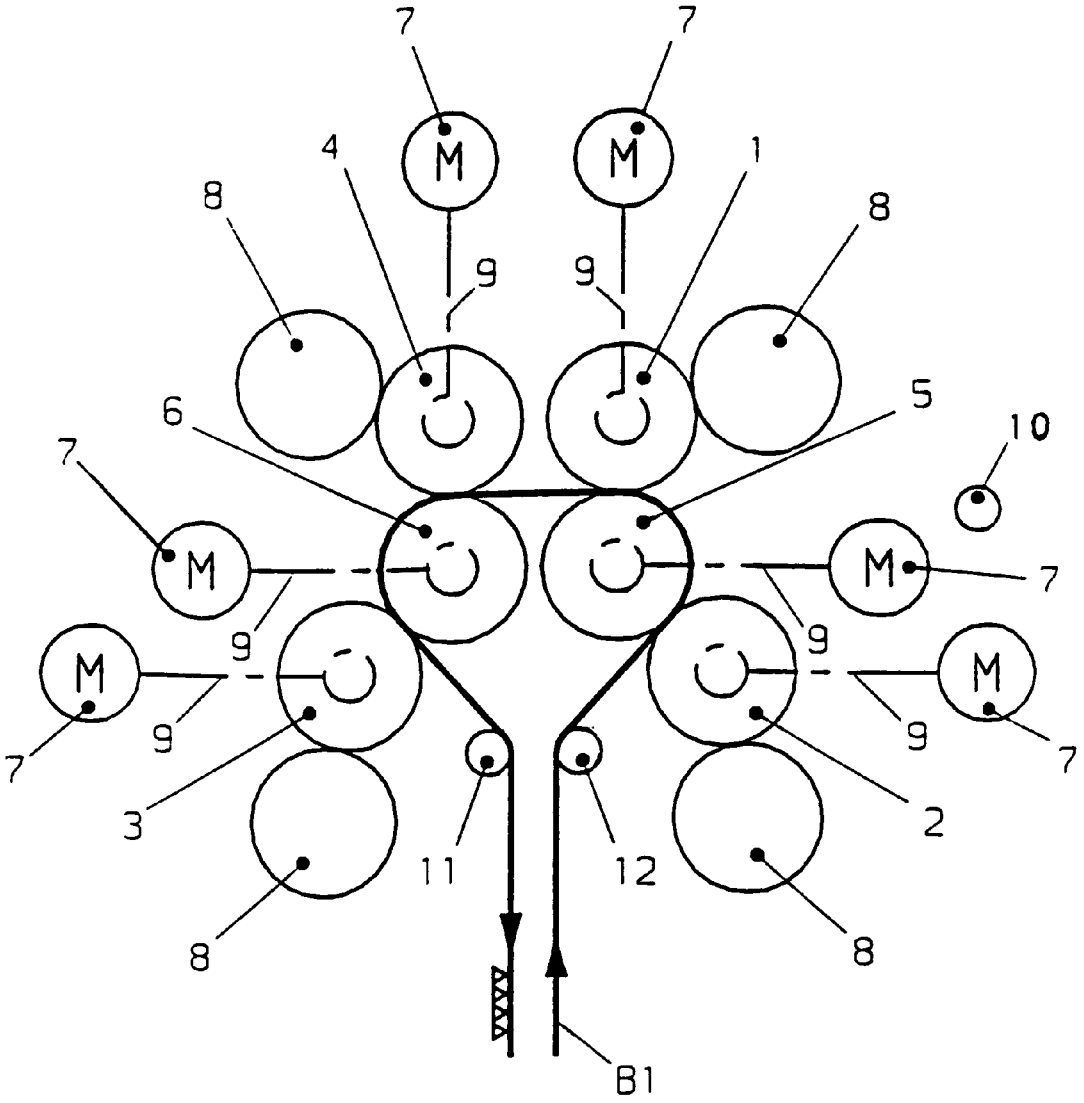
FIG. 1 is a schematic view of an H-shaped cylinder unit of a web-fed printing press according to the invention showing the cylinders forming printing gaps with counterpressure cylinders and showing a web running between two cylinders.

Referring to the drawings in particular, FIG. 1 shows an H-shaped cylinder unit of a web-fed printing press. The cylinder unit has four cylinders 1, 2, 3 and 4, which transfer printing ink onto a web $B_1$ and/or $B_2$. These four ink transfer cylinders 1 through 4 form a printing gap each, and a total of four printing gaps is formed with the two central counterpressure cylinders 5 and 6. The four ink transfer cylinders 1 through 4 in the exemplary embodiment are rubber blanket cylinders, while the central counterpressure cylinders 5 and 6 are designed as steel cylinders. One plate cylinder 8 each is associated in the known manner with each of the four ink transfer cylinders 1 through 4. The cylinder unit shown is called, in general, a 10-cylinder unit.

The arrangement of the ink transfer cylinders 1 through 4 as well as their plate cylinders 8 is symmetrical to an imaginary central vertical to the line connecting the axes of rotation of the two central counterpressure cylinders 5 and 6. However, the arrangement of the ink transfer cylinders 1 through 4 is not symmetrical to this line connecting the axes of rotation of the two counterpressure cylinders 5 and 6. The two ink transfer cylinders 2 and 3, which are arranged on one side of this connection line, are located at a greater distance from one another than are the two ink transfer cylinders 1 and 4 arranged on the other side of this connection line.

The clearance between the two ink transfer cylinders 2 and 3 is so great that a web $B_1$ can be led through the space between these two cylinders, can be printed on in a first printing gap between the ink transfer cylinder 2 and the counterpressure cylinder 5, can be passed on, wrapping around the counterpressure cylinder 5 and the counterpressure cylinder 6 one after another, can be printed on again in another printing gap, which is formed by the ink transfer cylinder 3 and its counterpressure cylinder 6, and can run out unhindered between the ink transfer cylinders 2 and 3, in parallel to the intake of the web in this exemplary embodiment. This is shown in FIG. 1. Two deflecting rollers 11 and 12, around which the web $B_1$ is deflected before and after wrapping around the two counterpressure cylinders 5 and 6, are arranged in the intermediate space between the two ink transfer cylinders 2 and 3 to define a web run region with a feed in region and out feed region.

The ink transfer cylinders 1 and 4, which are the upper ink transfer cylinders in the exemplary embodiment, are also in a printing-on position each against their respective counterpressure cylinders 5 and 6. The web $B_1$ is printed on four times on one side in the cylinder position shown. The advantage of the cylinder arrangement according to the present invention in this position of the ink transfer cylinders 1 through 4 is that the web $B_1$ does not wrap around any of the four printing cylinders 1 through 4. The web $B_1$ wraps around the two counterpressure cylinders 5 and 6 and runs tangentially to each of the four ink transfer cylinders 1 through 4. Each of these four ink transfer cylinders 1 through 4 can therefore be taken out from the production even with the web $B_1$ running, i.e., during a production, a 4.0 production in the exemplary embodiment, by pivoting it off from its corresponding counterpressure cylinder 5 or 6. This also applies to a pivoting on in the opposite case.

Figure 2:
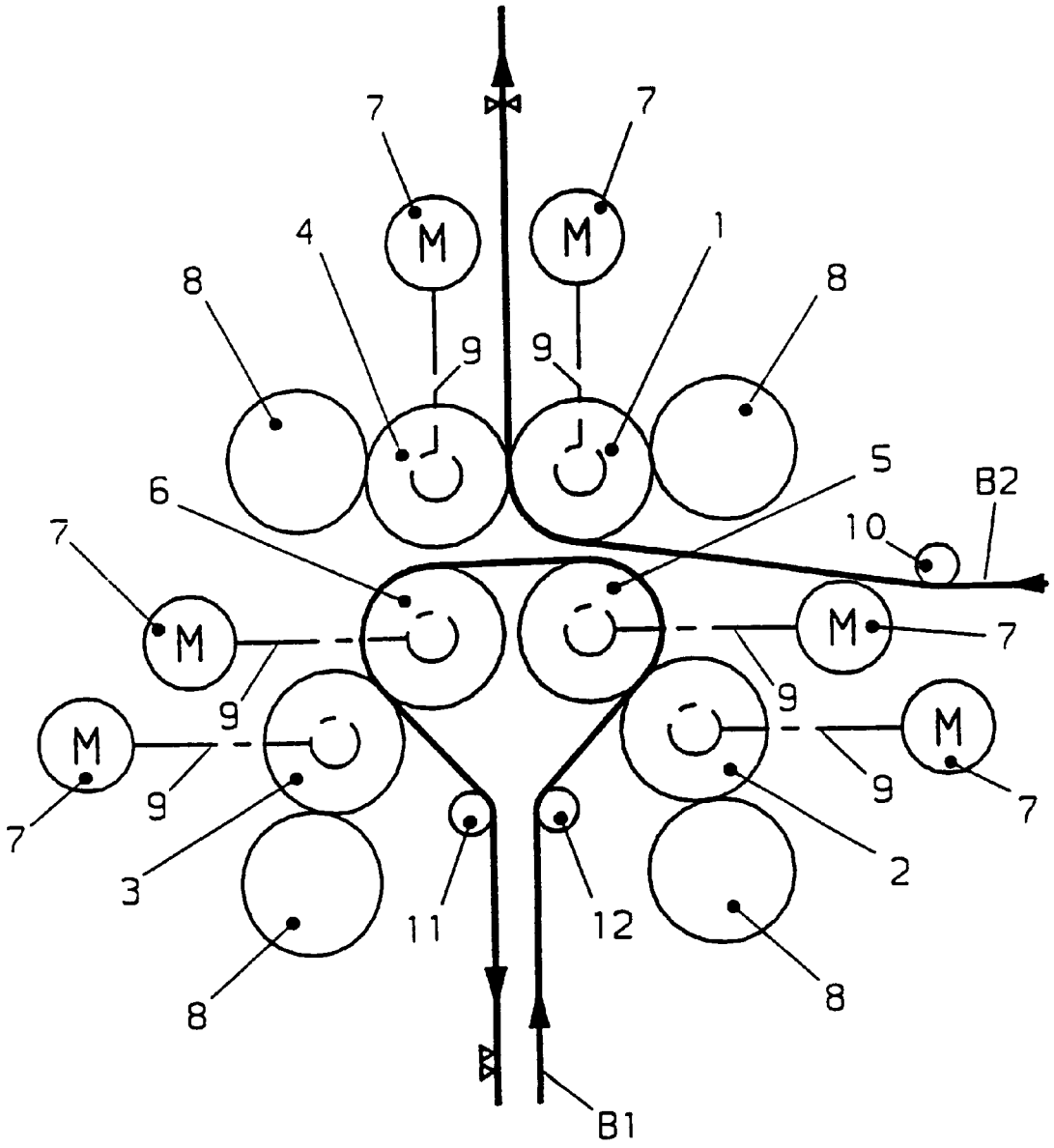
FIG. 2 is a schematic view of the H-shaped cylinder unit showing two cylinders in a non printing-on position with respect to the counterpressure cylinders and instead in a printing-on position in relation to one another.

While the ink transfer cylinders 2 and 3 that are the lower ink transfer cylinders in the exemplary embodiment are removed from the production by pivoting off, the two ink transfer cylinders 1 and 4 that are the upper ink transfer cylinders in the exemplary embodiment are spaced so close to one another that they can be reversed from their printing-on position against their corresponding counterpressure cylinder 5 or 6 into a printing-on position in relation to one another by pivoting off from the counterpressure cylinders 5 and 6 and by pivoting toward one another this alternative printing-on position of the two ink transfer cylinders 1 and 4 is shown in FIG 2. The two ink transfer cylinders 1 and 4 are each printing on opposite sides of another web in this alternative printing-on position. For example, a second web $B_2$ can be printed on, e.g., in one color on both sides by the two ink transfer cylinders 1 and 4 in the position as shown in FIG. 2. This position provides a first cylinder/fourth cylinder printing gap. Thus, a two-web production is shown in FIG. 2. The web $B_1$ is printed on here by the two ink transfer cylinders 2 and 3 one after another on one side in two colors, while the web $B_2$, deflected by deflecting cylinder 10 corresponding to the intended print production, is printed on by the two ink transfer cylinders 1 and 4 on both sides, in one color.

Not only is the arrangement according to the present invention especially flexible in terms of the feasible alternative production possibilities, but it is also especially compact. Compared with an H-shaped bridge with two central counterpressure cylinders, which is symmetrical with respect to both the line connecting the axes of rotation of the two counterpressure cylinders 5 and 6 and the central vertical to this connection line, overall height is saved by the nonsymmetrical arrangement according to the present invention due to the flat upper V bridge of the two ink transfer cylinders 1 and 4 as well as their plate cylinders 8. Because of the narrower distance between the two upper ink transfer cylinders, the upper V bridge is flatter at equal overall height than the lower N bridge of the 10-cylinder unit. At the same time, the advantages of the wrap-free guiding of the web (wrap-free also with respect to the two more closely spaced ink transfer cylinders) are obtained, because the pivoting on and off of ink transfer cylinders during running production is simplified due to the wrap-free guiding of the web, since the pivoting on and off of cylinders does not lead to vibrations of the web, which would not be tolerable with respect to the quality of the production. In particular, the path of the web is not changed by the pivoting on and off, i.e., by the reforming of printing gaps and print positions.

A preferred drive concept is also shown in the figure. There is no positive drive connection between the ink transfer cylinders 1 through 4 and the counterpressure cylinders 5 and 6 among each other. The cylinders 1 through 6 are at best in a frictional connection via the web and via bearer rings. Each of the cylinders 1 through 6 is driven by a separate motor 7. The force is transmitted from each of the motors 7 via a transmission 9, preferably a toothed belt, directly to the cylinders 1 through 6. The downstream plate cylinders 8 are positively connected with their corresponding ink transfer cylinders 1 through 4 to the drive, which is thus a common drive. As an alternative, it would be possible for the motors 7 to drive, instead of the ink transfer cylinders 1 through 4, the plate cylinders 8 associated with them likewise directly via a transmission, preferably likewise a toothed belt, and the ink transfer cylinders 1 through 4 would also be driven in this case in tow of their respective plate cylinder 8. It would also be possible to positively connect the two counterpressure cylinders 5 and 6 on the drive side with one of the ink transfer cylinders to the drive, which would thus be a common drive. However, the configuration shown in the figure with the separately driven counterpressure cylinders 5 and 6 is preferred because of the facilitated pivoting on and off of the ink transfer cylinders.

While a specific embodiment of the invention has been shown and described in detail to illustrate the application of the principles of the invention, it will be understood that the invention may be embodied otherwise without departing from such principles.

What is claimed is:

1. A cylinder unit for a web-fed printing press, comprising:

a first cylinder;

a second cylinder;

a common first counterpressure cylinder, said first cylinder and said second cylinder respectively forming a first cylinder printing gap and a second cylinder printing gap with said common first counterpressure cylinder;

a third cylinder;

a fourth cylinder;

a common second counterpressure cylinder, said third cylinder and said fourth cylinder respectively forming a third cylinder printing gap and a fourth cylinder printing gap with said common second counterpressure cylinder;

said first, second, third and fourth cylinders and said first and second counterpressure cylinders forming a single substantially H-shaped cylinder bridge;

said first cylinder and said fourth cylinder and said second cylinder and said third cylinder being arranged asymmetrically in relation to said common first and said common second counterpressure cylinders, said second and third cylinders being mounted spaced from one another at such a distance that a web can run in between said second and third cylinders in a printing-on position at said respective counterpressure cylinders and can run out after wrapping around said counterpressure cylinders, said second cylinder being independently movable into a non print position spaced from said first counterpressure cylinder during running production and said third cylinder being independently movable into a non print position spaced from said second counterpressure cylinder during running production; and said first and fourth cylinders being mounted spaced close to one another and each being independently movable during running production from a counterpressure cylinder printing-on position against their respective counterpressure cylinder, based on said first printing gap and said fourth printing gap into another printing-on position in relation to one another, spaced from said a counterpressure cylinder printing-on position and defining a first cylinder/fourth cylinder printing gap.

2. A cylinder unit in accordance with claim 1, further comprising two deflecting rollers wherein said web running in and out between said second and third cylinders runs in and out between two said deflecting rollers, said deflecting rollers being arranged in an intermediate space between said second and third cylinders and at spaced locations from said counterpressure cylinders.

3. A cylinder unit for a web-fed printing press, comprising:

a first cylinder;

a second cylinder;

a common first counterpressure cylinder mounted in a substantially fixed position, said first cylinder and said second cylinder respectively forming a first cylinder printing gap and a second cylinder printing gap with said common first counterpressure cylinder;

a third cylinder;

a fourth cylinder;

a common second counterpressure cylinder mounted in a substantially fixed position, said third cylinder and said fourth cylinder respectively forming a third cylinder printing gap and a fourth cylinder printing gap with said common second counterpressure cylinder;

said first, second, third and fourth cylinders and said first and second counterpressure cylinders forming a single substantially H-shaped cylinder bridge;

said second and third cylinders being mounted spaced from one another at such a distance that a web can run in between said second and third cylinders in a printing-on position at said respective counterpressure cylinders and can run out after wrapping around said counterpressure cylinders, said second cylinder being independently movable into a non print position spaced from said first counterpressure cylinder during running production and said third cylinder being independently movable into a non print position spaced from said second counterpressure cylinder during running production; and said first and fourth cylinders being mounted spaced close to one another and movable during running production from a counterpressure cylinder printing-on position against their respective counterpressure cylinder, based on said first printing gap and said fourth printing gap into another printing-on position in relation to one another, spaced from said a counterpressure cylinder printing-on position and defining a first cylinder/fourth cylinder printing gap.

4. A cylinder unit in accordance with claim 3, further comprising two deflecting rollers wherein said web running in and out between said second and third cylinders runs in and out between two said deflecting rollers, said deflecting rollers being arranged in an intermediate space between said second and third cylinders and at spaced locations from said counterpressure cylinders.

5. A cylinder unit for a web-fed printing press, comprising:

a first cylinder;

a second cylinder;

a common first counterpressure cylinder mounted in a substantially fixed position, said first cylinder forming a first cylinder printing gap with said common first counterpressure cylinder in a printing on position and said second cylinder forming a second cylinder printing gap with said common first counterpressure cylinder in a printing on position;

a third cylinder;

a fourth cylinder;

a common second counterpressure cylinder mounted in a substantially fixed position, said third cylinder forming a third cylinder printing gap with said common second counterpressure cylinder in a printing on position and said fourth cylinder forming a fourth cylinder printing gap with said common second counterpressure cylinder in a printing on position, said first, second, third and fourth cylinders and said first and second counterpressure cylinders forming a single substantially H-shaped cylinder bridge, said first cylinder and said fourth cylinder and said second cylinder and said third cylinder being arranged asymmetrically in relation to said common first and said common second counterpressure cylinders, said second cylinder being movable from said printing on position into a non print position spaced from said first counterpressure cylinder and said third cylinder being movable from said printing on position into a non print position spaced from said second counterpressure cylinder, said second and third cylinders being mounted spaced from one another at such a distance to define a web run region with a feed in region, between said second and third cylinders in said printing-on position, and an out feed region, between said second and third cylinders in said printing-on position, said first and fourth cylinders being mounted spaced close to one another and movable from said printing-on position into another printing-on position spaced from said counterpressure cylinder and defining a first cylinder/fourth cylinder printing gap, said first cylinder, said second cylinder, said common first counterpressure cylinder, said third cylinder, said fourth cylinder and said common second counterpressure cylinder defining a first web path extending through said feed in region, wrapping around said counterpressure cylinders through said out feed region and a simultaneously usable second web path passing between said first and fourth cylinders and through a second web feed in region between one of said counterpressure cylinders and an associated one of said first and fourth cylinders in said another printing on position.

6. A cylinder unit in accordance with claim 5, further comprising two deflecting rollers wherein said web running in and out between said second and third cylinders runs in and out between two said deflecting rollers, said deflecting rollers being arranged in an intermediate space between said second and third cylinders and at spaced locations from said counterpressure cylinders.

7. A cylinder unit in accordance with claim 5, wherein said first cylinder and said fourth cylinder are movable during running production between said counterpressure cylinder printing-on position and said another printing-on position.

* * * * *